US008844316B1

(12) United States Patent
Ademola et al.

(10) Patent No.: US 8,844,316 B1
(45) Date of Patent: Sep. 30, 2014

(54) DUAL CHAMBER DRINK CONTAINER SYSTEM

(71) Applicants: Omotolani Ademola, Pawtucket, RI (US); Naomi Saint Cilien, East Taunton, MA (US)

(72) Inventors: Omotolani Ademola, Pawtucket, RI (US); Naomi Saint Cilien, East Taunton, MA (US)

( * ) Notice: Subject to any disclaimer, the term of this patent is extended or adjusted under 35 U.S.C. 154(b) by 4 days.

(21) Appl. No.: 13/886,720

(22) Filed: May 3, 2013

(51) Int. Cl.
*F25D 3/08* (2006.01)
*A47G 19/22* (2006.01)

(52) U.S. Cl.
CPC ..... *A47G 19/2288* (2013.01); *A47G 19/2222* (2013.01); *F25D 3/08* (2013.01); *F25D 2303/0842* (2013.01)
USPC ..... 62/457.3; 62/293

(58) Field of Classification Search
CPC ..... F25D 3/06; F25D 3/00; F25D 11/006; F25D 31/002; F25D 31/003; F25D 2303/082; F25D 2303/08221; F25D 2303/0831; F25D 2303/0832; F25D 2303/083; F25D 2303/084
USPC ..... 62/457.3, 457.4, 293
See application file for complete search history.

(56) References Cited

U.S. PATENT DOCUMENTS

| | | | | |
|---|---|---|---|---|
| 6,318,114 | B1 * | 11/2001 | Slaughter | 62/457.2 |
| 6,513,343 | B2 * | 2/2003 | Pahl | 62/457.3 |
| 2005/0229626 | A1 * | 10/2005 | Akopyan | 62/457.3 |
| 2007/0158352 | A1 * | 7/2007 | Cheng | 220/662 |
| 2010/0178393 | A1 * | 7/2010 | Paracuellos Pulgarin | 426/86 |

* cited by examiner

*Primary Examiner* — Cassey D Bauer

(57) ABSTRACT

A dual chamber drink container system for chilling and containing quid in at least one chamber features a side wall interior surface having a first groove and a second groove located from a container top to a container bottom. A first liquid level window and a second liquid level window are located in the side wall. The system features a circular lid with a first pop up straw located in a first straw aperture and a second pop up straw located in a second straw aperture. The system features a planar divider adapted to be inserted into the first groove via a first tongue and the second groove via a second tongue. The divider is adapted to provide a chilling source for the system. The system features a cylindrical powder tube located on an exterior side wall adapted to store powdered drink mix.

4 Claims, 4 Drawing Sheets

DUAL CHAMBER DRINK CONTAINER SYSTEM

FIELD OF THE INVENTION

The present invention relates to drinking containers, or more specifically chilled drinking containers.

BACKGROUND OF THE INVENTION

Drinking containers have been around for millennia due to the fact that both mankind and the animal kingdom each require water for life. Chilled drinking containers, developed more recently, provide insulation—usually around the outside perimeter of the container—in order to maintain the temperature of the fluid in the container. The present invention features a dual chamber drink container system for chilling and containing liquid in at least one chamber. Both chambers may contain different fluids and are kept separately from each other.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a dual chamber drink container system for chilling and containing liquid in at least one chamber. In some embodiments, a side wall interior surface composes a first groove and a second groove located from a container top to a container bottom. In some embodiments, a first liquid level window and a second liquid level window are located in the side wall.

In some embodiments, the system comprises a circular lid. In some embodiments, a first pop up straw is located in a first straw aperture and a second pop up straw is located in a second straw aperture. In some embodiments, the system comprises a planar divider. In some embodiments, the divider is adapted to be inserted into the first groove via a first tongue and the second groove via a second tongue. In some embodiments, the divider is adapted to provide a chilling source for the system. In some embodiments, the system comprises a cylindrical powder tube located on an exterior side wall adapted to store powdered drink mix.

DESCRIPTION OF PREFERRED EMBODIMENTS

Figure 1:
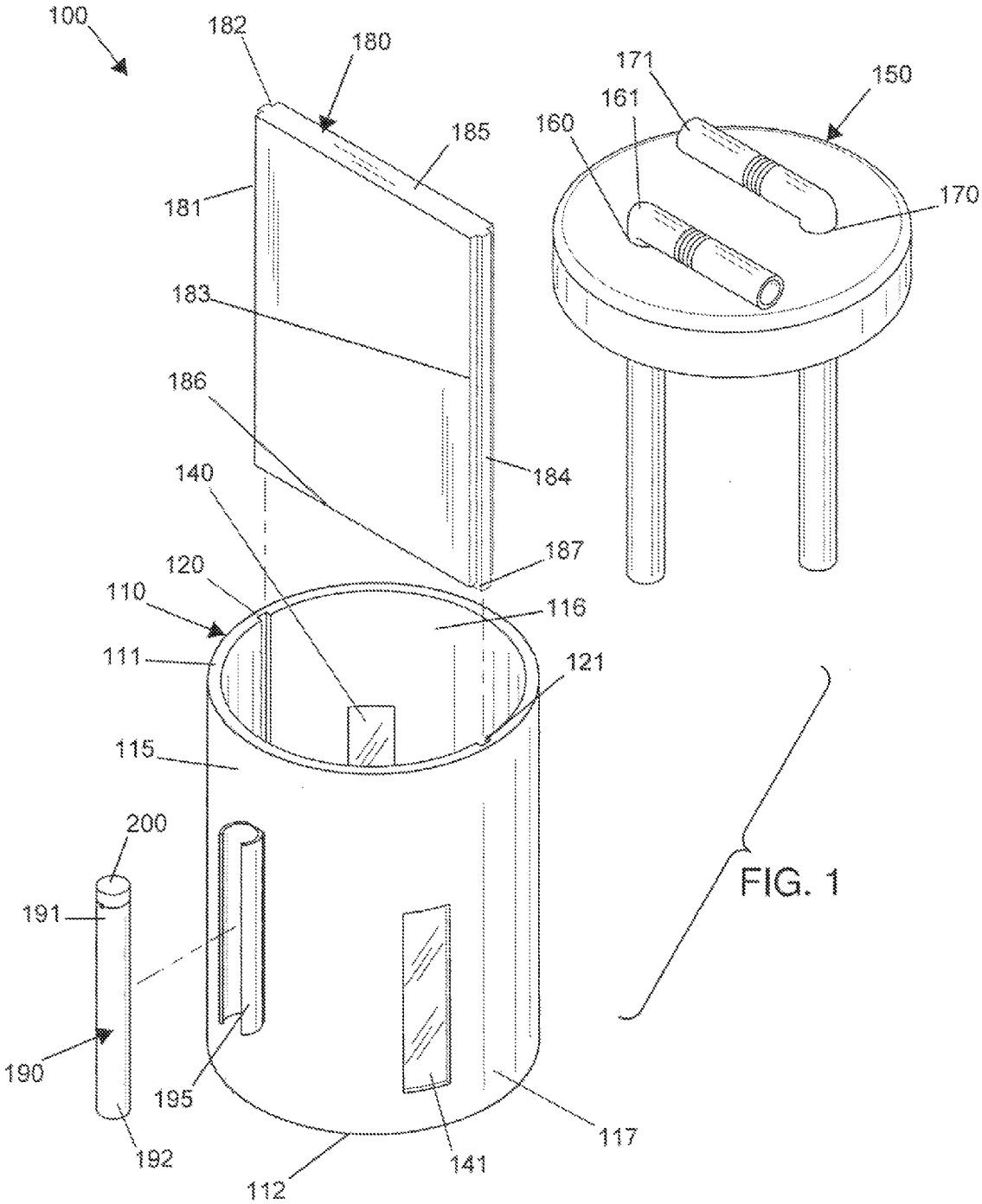
FIG. 1 shows a perspective view of the present invention.
Figure 3:
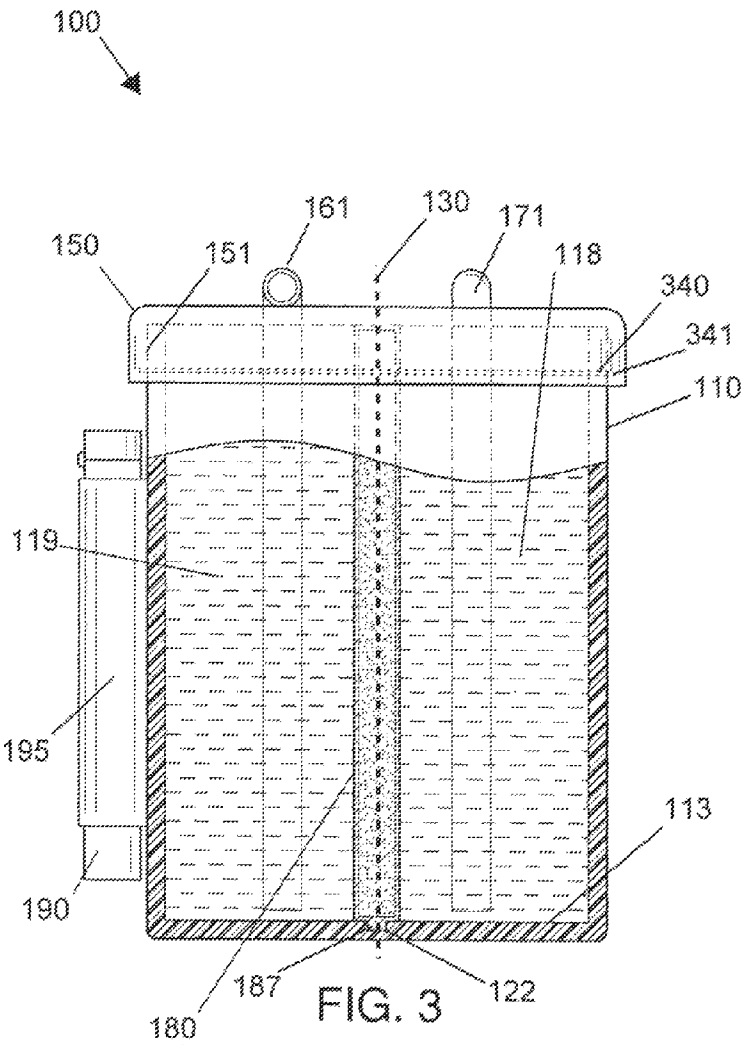
FIG. 3 shows a cross-sectional view of the present invention.
Figure 2:
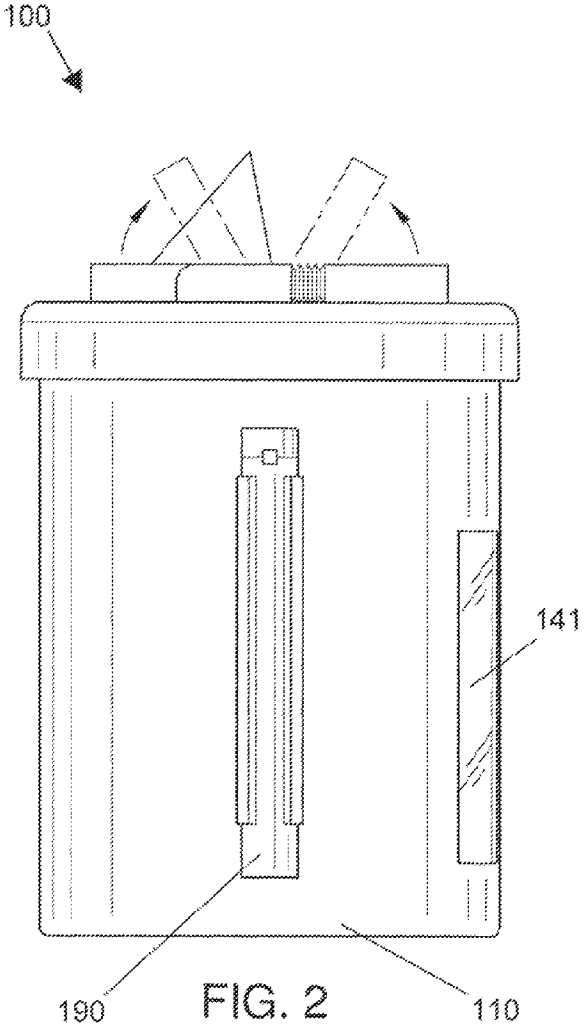
FIG. 2 shows a side view of the present invention.
Figure 4:
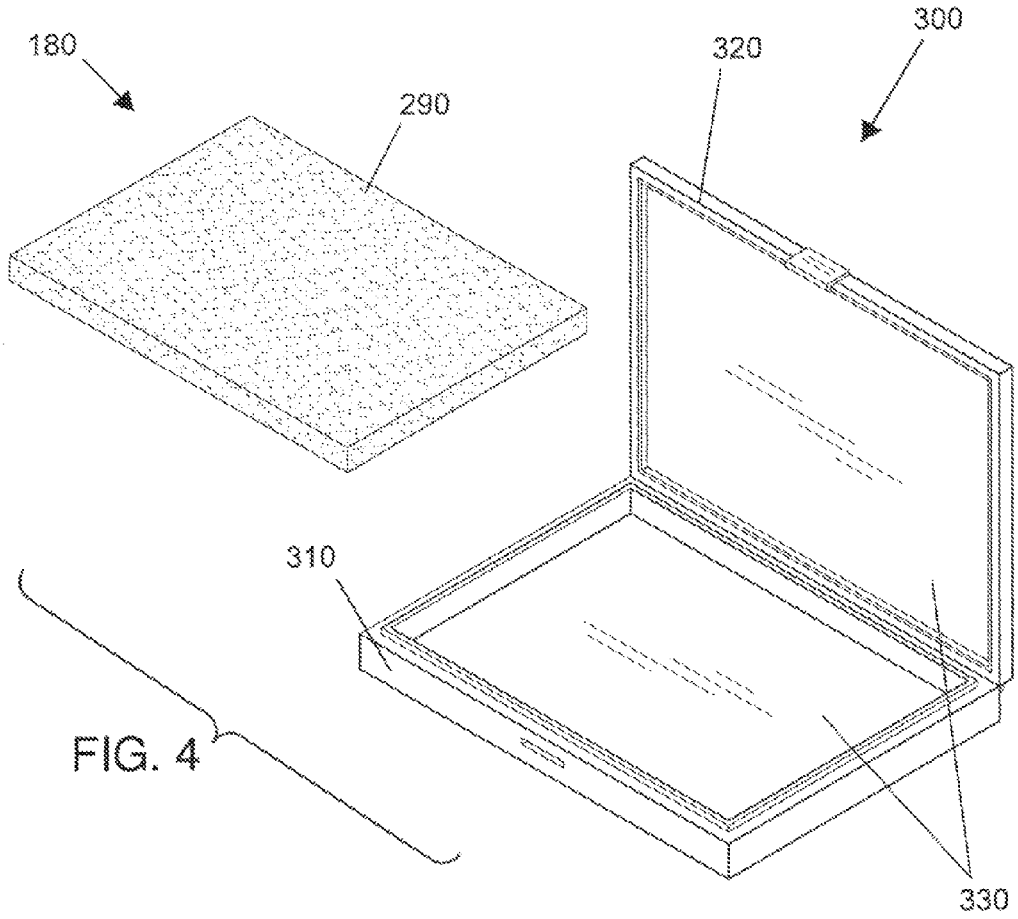
FIG. 4 shows a perspective view of the ice tray of the present invention.
Figure 5:
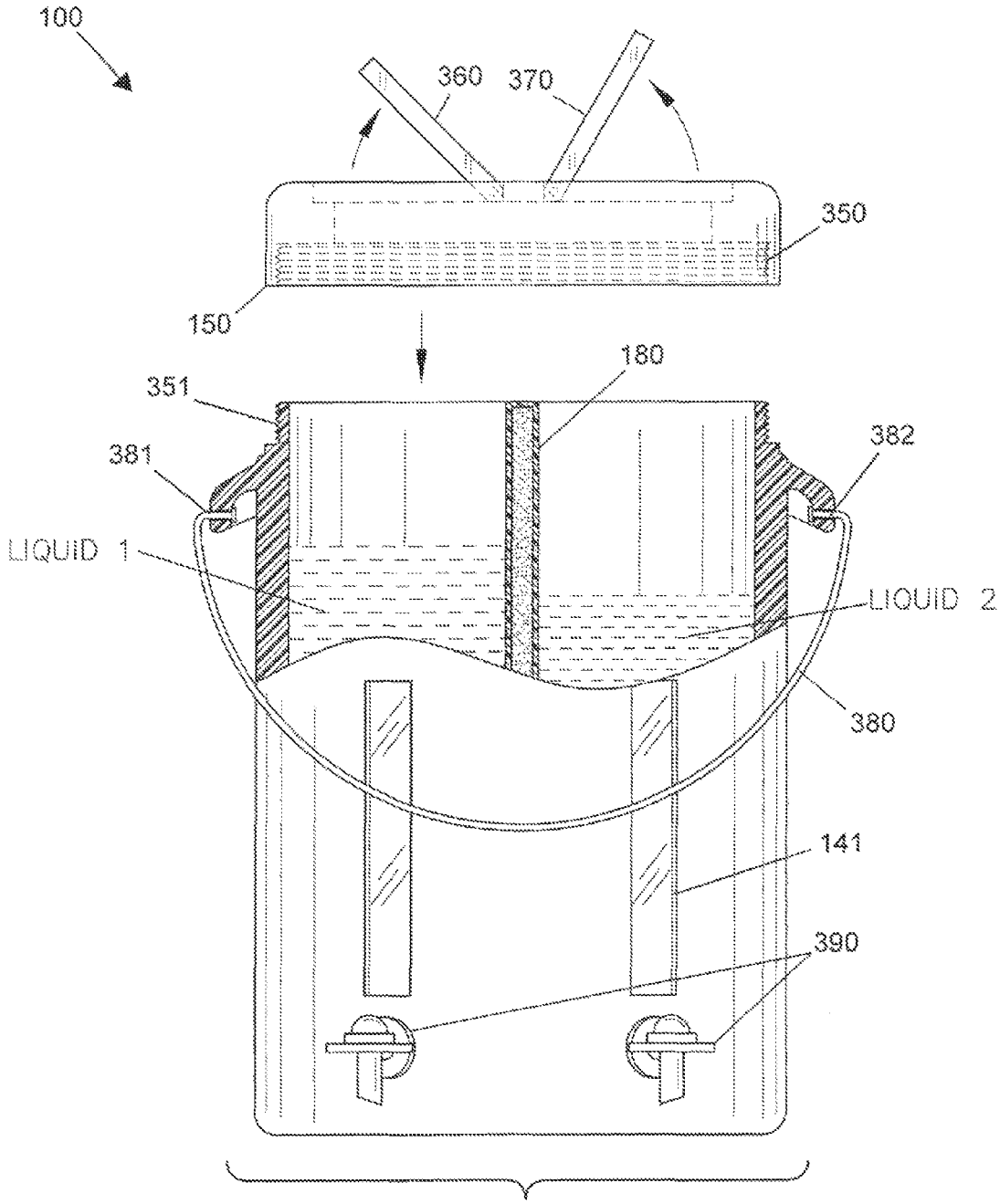
FIG. 5 shows a cross-sectional view of an alternate embodiment of the present invention.

Following is a list of elements corresponding to a particular element referred to herein:

100 Dual chamber drink container system
110 Container
111 Container top
112 Container bottom
113 Container bottom inside surface
115 Container side wall
116 Side wall interior surface
117 Side wall exterior surface
118 Container anterior chamber
119 Container posterior chamber
120 First groove
121 Second groove
122 Third groove
130 Dividing plane
140 First liquid level window
141 Second liquid level window
150 Lid
151 Lid inside rim interior surface
160 First straw aperture
161 First pop up straw
170 Second straw aperture
171 Second pop up straw
180 Divider
181 Divider first side
182 First tongue
183 Divider second side
184 Second tongue
185 Divider top
186 Divider bottom
187 Third tongue
190 Powder tube
191 Tube top
192 Tube bottom
195 Tube clamp
200 Tube lid
290 Ice
300 Ice tray
310 Ice tray first side
320 Ice tray second side
330 Silicone liner
340 First side snap system
341 Second side snap system
350 Internal threads
351 External threads
360 First door
370 Second door
380 Handle
381 Handle first end
382 Handle second end
390 Spigot Referring now to FIG. 1-5, the present invention features a dual chamber drink container system (100) for chilling and sealably containing liquid in at least one chamber. In some embodiments, the system (100) comprises two chambers. In some embodiments, the system (100) comprises a cylindrical container (110) having an open container top (111), a container bottom (112), and a cylindrical container side wall (115) having a side wall interior surface (116) and a side wall exterior surface (117). In some embodiments, the side wall interior surface (116) comprises a first groove (120) and a second groove (121) located thereon. In some embodiments, the first groove (120) is located from the container top (111) to the container bottom (112). In some embodiments, the second groove (121) is located from the container top (111) to the container bottom (112) opposite the first groove (120). In some embodiments, a container bottom inside surface (113) comprises a third groove (122) located thereon from the first groove (120) to the second groove (121). In some embodiments, the first groove (120), the second groove (121), and the third groove (122) are located on a dividing plane (130). In some embodiments, a first liquid level window (140) is located in the container side wall (115) anterior to the dividing plane (130). In some embodiments, a second liquid level window (141) is located in the container side wall (115) posterior to the dividing plane (130). In some embodiments, the container (110) is insulated. In some embodiments, the first groove (120), the second groove (121), and the third groove (122) comprise a sealing member located therein, for example silicone rubber.

In some embodiments, the system (100) comprises a circular lid (150) having a first straw aperture (160) and a second straw aperture (170) located therein. In some embodiments, a first pop up straw (161) is located through the first straw aperture (160) and a second pop up straw (171) is located through the second straw aperture (170). In some embodiments, the first pop up straw (161) and the second pop up straw (171) are formed into the lid and connected thereto.

In some embodiments, the system (100) comprises a planar divider (180) located on the dividing plane (130) having a divider first side (181) comprising a first tongue (182), a divider second side (183) comprising a second tongue (184), a divider top (185), and a divider bottom (186) comprising a third tongue (187). In some embodiments, the divider (180) is adapted to be inserted into the first groove (120) via the first tongue (182), the second groove (121) via the second tongue (184), and the third groove (122) via the third tongue (187). In some embodiments, the divider (180) comprises a freezable liquid and is adapted to provide a chilling source for the system (100). In some embodiments, a container anterior chamber (118) and a container posterior chamber (119) are formed via insertion of the divider (180). In some embodiments the divider (180) is an ice pack comprising a freezable liquid or gel encased by a durable plastic housing.

In some embodiments, the system (100) comprises a cylindrical powder tube (190) having an open tube top (191) and a tube bottom (192) attachably located on the side wall exterior surface (117) thereon via a tube clamp (196). In some embodiments, a tube lid (200) is sealably located on the powder tube (190). In some embodiments, the powder tube (190) is adapted to more powdered drink mix.

In some embodiments, the divider (180) is chilled before insertion into the container (110). In some embodiments, the divider (180) is inserted in the container (110) for providing a chilling source for the system (100) as well as to form the container anterior chamber (118) and the container posterior chamber (119). In some embodiments, liquid or solids are placed in either the container anterior chamber (118) or the container posterior chamber (119) or both. In some embodiments, the lid (150) is located on the container (110). In some embodiments, if the divider (180) is lifted, the contents of the container anterior chamber (118) and the container posterior chamber (119) are allowed to mix.

In some embodiments, the divider (180) is a sheet of ice (290). In some embodiments, when the divider (180) constructed from a sheet of ice (290) melts, the contents of the container anterior chamber (118) and the container posterior chamber (119) are allowed to mix. In some embodiments, the sheet of ice (290) is formed via freezing water in a refillable molded ice tray (300). In some embodiments, the ice tray (300) comprises an ice tray first side (310) pivotally attached to an ice tray second side (320). In some embodiments, the ice tray (300) comprises a silicone liner (330) located therein. In some embodiments, water is poured into the silicone liner (330) of the ice tray (300). In some embodiments, the ice tray first side (310) is pivoted onto the ice tray second side (320) for closing the ice tray (300) and inserted into a freezer for freezing.

In some embodiments, the divider (180) constructed from a sheet of ice (290) comprises a divider first side (181) comprising a first tongue (182), a divider second side (183) comprising a second tongue (184), a divider top (185), and a divider bottom (186) comprising a third tongue (187). In some embodiments, the divider (180) is adapted to be inserted into the first groove (120) via the first tongue (182), the second groove (121) via the second tongue (184), and the third groove (122) via the third tongue (187).

In some embodiments, the lid (150) is a snap on lid (150) having a first side snap system (340) located on a lid inside rim interior surface (151) thereon and a second side snap system (341) located on a side wall exterior surface (117) thereon. In some embodiments, the first side snap system (340) is a bump or a ridge. In some embodiments, the first side snap system (340) is a dimple, a slot or a groove. In some embodiments, the second side snap system (341) is a bump or a ridge. In some embodiments, the second side snap system (341) is a dimple, a slot or a groove.

In some embodiments, the lid (150) is a screw on lid (150) having internal threads (350) on a lid inside rim interior surface (151) thereon and external threads (351) located on a side wall exterior surface (117) thereon.

In some embodiments, the lid (150) comprises a first door (360) pivotally located thereon. In some embodiments, the first door (360) is sea ably located over the first straw aperture (160). In some embodiments, the lid (150) comprises a second door (370) pivotally located thereon. In some embodiments, the second door (370) is sealably located over the second straw aperture (170).

In some embodiments, the container (110) comprises a handle (380) located on the side wail exterior surface (117) thereon. In some embodiments, the handle (380) comprises a handle first end (381) and a handle second end (382). In some embodiments, the handle first end (381) is located on the side wall exterior surface (117). In some embodiments, the handle second end (382) is located on an opposite side wall exterior surface (117).

In some embodiments, the container (110) comprises a spigot (390) located in the container side wall (115) thereon. In some embodiments, the spigot (390) is fluidly connected to the container anterior chamber (118) or the container posterior chamber (119). In some embodiments, a first spigot (390) is located in the container side wall (115) thereon and fluidly connected to the container anterior chamber (118). In some embodiments, a second spigot (380) is located in the container side wall (115) thereon and fluidly connected to the container posterior chamber (119).

In some embodiments, the container (110) is an 8 ounce container (110). In some embodiments, the container (110) is a 16 ounce container (110). In some embodiments, the container (110) is a 24 ounce container (110). In some embodiments, the container (110) is a 32 ounce container (110). In some embodiments, the container (110) is a 48 ounce container (110). In some embodiments, the container (110) is a 64 ounce container (110). In some embodiments, the container (110) is a 128 ounce container (110). In some embodiments, the container (110) is a one gallon container (110). In some embodiments, the container (110) is a two gallon container (110). In some embodiments, the container (110) is a three gallon container (110). In some embodiments, the container (110) is a five gallon container (110). In some embodiments, the container (110) comprises more than five gallons.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A dual chamber drink container system (100) for chilling and sealably containing liquid in at least one chamber, wherein the system (100) comprises:

(a) a cylindrical container (110) having an open container top (111), a container bottom (112), and a cylindrical container side wall (115) having a side wall interior surface (116) and a side wall exterior surface (117), wherein the side wall interior surface (116) comprises a first groove (120) and a second groove (121) disposed thereon, wherein the first groove (120) is disposed from the container top (111) to the container bottom (112), wherein the second groove (121) is disposed from the container top (111) to the container bottom (112) opposite the first groove (120), wherein a container bottom inside surface (113) comprises a third groove (122) disposed thereon from the first groove (120) to the second groove (121), wherein the first groove (120), the second groove (121), and the third groove (122) are disposed on a dividing plane (130), wherein a first liquid level window (140) is disposed in the container side wall (115) anterior to the dividing plane (130), wherein a second liquid level window (141) is disposed in the container side wall (115) posterior to the dividing plane (130);

(b) a circular lid (150) having a first straw aperture (160) and a second straw aperture (170) disposed therein, wherein a first pop up straw (161) it disposed Through the first straw aperture (160) and a second pop up straw (171) is disposed through the second straw aperture (170);

(c) a planar divider (180) disposed on the dividing plane (130) having a divider first side (181) comprising a first tongue (182), a divider second side (183) comprising a second tongue (184), a divider top (185), and a divider bottom (186) comprising a third tongue (187), wherein the divider (180) is adapted to be inserted into the first groove (120) via the first tongue (182), the second groove (121) via the second tongue (184), and the third groove (122) via the third tongue (187), wherein the divider (180) comprises a freezable liquid and is adapted to provide a chilling source for the system (100), wherein a container anterior chamber (118) and a container posterior chamber (119) are formed via insertion of the divider (180); and (d) a cylindrical powder tube (190) having an open tube top (191) and a tube bottom (192) attachably disposed on the side well exterior surface (117) thereon via a tube clamp (195), wherein a tube lid (200) is sealably disposed on the powder tube (190), wherein the powder tube (190) is adapted to store powdered drink mix;

wherein, the divider (180) is chilled before insertion into the container (110), wherein the divider (180) is inserted in the container (110) for providing a chilling source for the system (100) and to form the container anterior chamber (118) and the container posterior chamber (119), wherein liquid or solids are placed in either the container anterior chamber (118) or the container posterior chamber (119) or both, wherein the lid (150) is disposed on the container (110).

2. The system (100) of claim 1, wherein the divider (180) is a sheet of ice (290), wherein the sheet of ice (290) is formed via freezing water in a refillable molded ice tray (300), wherein the ice tray (300) comprises an ice tray first side (310) pivotally attached to an ice tray second side (320), wherein the ice tray (300) comprises a silicone liner (330) disposed therein, wherein water is poured into the silicone liner (330) of the ice tray (300), wherein the ice tray first side (310) is pivoted onto the ice tray second side (320) for closing the ice tray (300) and inserted into a freezer for freezing.

3. The system (100) of claim 1, wherein the lid (150) is a snap on lid (150) having a first side snap system (340) disposed on a lid inside rim interior surface (151) thereon and a second side snap system (341) disposed on a side wall exterior surface (117) thereon.

4. The system (100) of claim 1, wherein the lid (150) is a screw on lid (150) having internal threads (350) a lid inside rim interior surface (151) thereon and external threads (351) disposed on a side wall exterior surface (117) thereon.

* * * * *